United States Patent [19]

Ambasz

[11] 4,131,260

[45] Dec. 26, 1978

[54] CHAIR SEAT MOUNT WHICH PERMITS THE SEAT TO TILT FORWARD

[75] Inventor: Emilio Ambasz, New York, N.Y.

[73] Assignee: Center for Design Research and Development N.V., Curacao, Netherlands Antilles

[21] Appl. No.: 875,801

[22] Filed: Feb. 7, 1978

Related U.S. Application Data

[63] Continuation-in-part of Ser. No. 795,098, May 9, 1977.

[51] Int. Cl.[2] ..... A45D 19/04

[52] U.S. Cl. ..... 248/384; 248/372; 248/382; 297/326

[58] Field of Search ..... 248/371, 372, 375, 382, 248/384, 385, 387, 388, 391; 297/261, 264, 265, 301–303, 313, 326

[56] References Cited

U.S. PATENT DOCUMENTS

| | | | |
|---|---|---|---|
| 2,132,291 | 10/1938 | Fitos | 248/382 |
| 2,729,293 | 1/1956 | Hamilton et al. | 297/303 X |
| 3,547,393 | 12/1970 | Gordin | 248/385 |
| 4,025,020 | 5/1977 | Goff et al. | 248/385 |

*Primary Examiner*—James C. Mitchell

*Attorney, Agent, or Firm*—Brumbaugh, Graves, Donohue & Raymond

[57] ABSTRACT

The seat of a chair is mounted on a post or other supporting member by a seat mount which permits the seat to tilt forward (front end down) to a forward and downward rake of about 4½°. A bracket connected to the seat and located under generally the center of the seat pivots on an axle that is received and supported by a mounting plate rigidly fastened to the supporting member. Springs compressed between the mounting plate and the bracket restrain the seat from tilting down, and co-engageable stop surfaces associated with the bracket and mounting plate limit the extent of tilting of the seat (both forward and backward rake, when the latter is provided for). By joining the mounting plate and bracket by parallel front and rear axles fixed to the bracket and arranged to disengage axle-engaging surfaces on the plate, or vice versa, the seat can tilt both forward and backward; in this mode, the seat pivots or rocks on one axle, and the other axle disengages the axle-engaging surface. An optional movable blocking element can be included to disable the rearward tilt mode when desired.

34 Claims, 41 Drawing Figures

CHAIR SEAT MOUNT WHICH PERMITS THE SEAT TO TILT FORWARD

BACKGROUND OF THE INVENTION

This is a continuation-in-part of U.S. patent application Ser. No. 795,098 filed May 9, 1977, for "Chairs With Seats That Tilt Forward."

Desk chairs are almost universally constructed to tilt rearwardly, a feature which reduces the fatigue of sitting all day long at a desk or a work table or counter by permitting the sitter to lean back and relax from time to time. In the usual desk chair the seat and back are mounted on a bracket which, in turn, is mounted by an axle on a bracket affixed to the top of the post of a pedestal base. A heavy spring, which is usually adjustable, restrains the seat against tilting back, and forward and rearward stops limit the degree of tilting to, at one extreme, a normal upright position with the seat at a slight rearward rake and, at the other extreme, a full back position with the seat at a substantial rearward rake.

Prior inventions of the inventor of the subject matter hereof provide another, better way of increasing the comfort of chairs (see U. S. Pat. No. 3,982,785 and U.S. patent application Ser. No. 759,077 filed Jan. 13, 1977, now U.S. Pat. No. 4,046,422), forward and backward sliding of the seat and independent tilting of the back so that the chair automatically changes configuration to support the sitter anatomically in various postures between sitting upright and relaxing backward.

It is, of course, frequently necessary for persons to lean forward in a chair to work on things on a desk, table or counter. It has been recognized for some time that most chairs are not only uncomfortable in a forward-leaning position but can also reduce blood circulation to the lower legs due to pressure from the chair seat on the back of the thighs. It has been proposed, as a possible way of making chairs more comfortable to sit in when leaning forward, to construct them with a lesser rearward rake of the seat or with even a slight forward rake. Such proposals have not so far been adopted on a widespread basis, probably because the improved comfort when leaning forward is obtained by trading off comfort when sitting upright. Therefore, it has also been suggested that chairs be constructed with mechanisms, for example, lockable, adjustable gas springs, that permit the rake of a chair seat to be adjusted from time to time.

SUMMARY OF THE INVENTION

There is provided, in accordance with the present invention, a seat mount by which a chair seat is mounted on a base in a manner which permits the seat to tilt forward automatically when a person sitting in the chair leans forward. The seat tilts forward about a horizontal transverse axis such that the front of the seat is a substantial distance below the back and the seat is at an inclination of as much as about 4½° forward rake. Ordinarily, the back and the frame carrying the seat and back will tilt forward as a unit, but that is not essential.

The seat mount includes a mounting plate that is rigidly secured to the chair base and a seat-supporting bracket that supports the seat, the bracket being located approximately under the center of the seat. A transverse axle connects the bracket to the mounting plate and permits the seat to tilt about the axis of the axle. One or more compression springs are engaged under compression between the bracket and the mounting plate, the springs being positioned relative to the axle to apply a force between the bracket and mounting plate in a direction tending to pivot the seat rearwardly and thus yieldably restrain forward tilting of the seat. Co-engaging stop surfaces on the mounting plate and bracket limit the extent of forward tilting of the seat.

In the particular embodiments of the invention shown in the accompanying drawings and described hereinafter the seat mount assembly (which consists of the mounting plate, bracket, springs and axle) is of relatively small size, employs a limited number of parts and can be constructed and assembled easily at relatively low cost. Moreover, it is constructed in such a way as to be visually concealed and physically protected.

More particularly, some embodiments of the invention comprise a mounting plate that includes a pair of generally horizontally and transversely oriented flange portions, each of which portions has at least one downwardly open spring retainer cup for receiving and retaining in position a compression spring. The mounting plate includes suitable means for rigidly attaching it to a chair base or other support, such as a centrally located boss that has a socket for receiving the upper end of the post of a pedestal or caster base. The bracket includes a generally horizontally and transversely oriented web portion that is located below the flanges and which is engaged by the springs. Spaced-apart axle holders extend upwardly from the web portion of the bracket adjacent the ends of the mounting plate and receive an axle which joins the mounting plate to the bracket. Appropriately located stop surfaces are provided in association with the mounting plate, and companion stop surfaces are provided in association with the bracket. By making the bracket generally U-shaped in cross section and oriented with the base portion down and the legs pointed up, the legs or flanges conceal the mounting plate and springs.

The seat mount can, according to the invention, be constructed to permit the seat not only to tilt forward but also to tilt back. In some forms of such an arrangement, the mounting plate and bracket are joined by two parallel, spaced-apart axles which are fixed to the bracket and seat on corresponding axle-engaging surfaces on the mounting plate. The axle-engaging surfaces, in such a configuration, are upwardly open concave surfaces in the top of the mounting plate which allow either one of the axles to unseat and move upwardly while the bracket pivots on the mounting plate about the other axle; for example, when the seat tilts forward about the front axle, the rear axle lifts up and out of the rear axle-engaging or axle-supporting surface. As a further optional feature, the mount may be provided with a locking or blocking member that can be moved into a position locking the front axle to the mounting plate, thereby preventing rearward tipping of the seat.

In other embodiments constructed to permit both backward and forward tilting of the seat, the arrangement of the axles and axle-engaging surfaces is reversed from the versions described in the preceding paragraph. Spaced-apart front and rear transverse horizontal axles are joined to the mounting plate with their axes parallel and fixed relative to the plate, and cavities in the bracket corresponding to each axle receive the respective axles, such that the bracket hangs from the axles. The front cavities are shaped and dimensioned to permit the bracket to tilt rearwardly, the bracket pivoting about the rear axle and the front cavities being lifted up out of engagement with the front axle. Similarly, the rear cavities are shaped and dimensioned to permit the rear part of the bracket to lift up as the bracket pivots about the front axle thus to tilt the chair seat forward. Rearward tilting is yieldably restrained by one or more front springs located forwardly of the rear axle and engaged between the plate and a web portion of the bracket located under the plate, and forward tilting is yieldably restrained by one or more rear springs located rearwardly of the front axle and interposed between the web portion of the bracket. The limits of tilting are, preferably, established by engagement between the under sides of the axles and the bottoms of the cavities.

From the foregoing it is apparent that the forward-tilt feature provided by the present invention is entirely automatic in that it involves no intervention by the person sitting in the chair, other than leaning forward, to shift the seat from a normal rake to a forward rake. The front of the seat will automatically tilt down when the person sitting in it leans forward, thus moving his center of gravity forward.

In cases in which the chair seat mount, according to the present invention, is used in conjunction with a chair having a seat mounted on seat supports to slide forward and backward and a back which pivots or tilts rearwardly, such as the chairs described in the aforementioned patent and application, the tilt rearward mechanism of a seat mount embodying the present invention will not come into play until after the chair itself is self adjusted to a configuration with the seat forwardmost and the back tilted rearwardly. If at that point the person sitting in the chair wants to tilt the chair even further back, the seat mount of the present invention will then permit rearward tilting. The purpose of the mechanism for disabling the rearward tilting structure of the seat mount is primarily to make the automatic adjustments of the configurations of the chairs predominant.

The invention is useful in virtually any type of office operational or managerial seating but provides particular advantages in satisfying the specialized working requirements of persons who are called upon to lean over desks or counters for long periods of time at frequent intervals. The present invention contributes additional comfort and versatility to chairs that embody the inventions of the prior patent and application referred to above by extending the scope of automatic adaptation of the chair to sitting positions to a tilt-forward posture and, with seat mounts with tilt-backward capability, a tilt-backward posture.

DESCRIPTION OF THE EMBODIMENTS

The chair shown in FIGS. 1 to 4 includes the features described in U.S. patent application Ser. No. 759,077, now U.S. Pat. No. 4,046,422 (referred to above) in that it includes a beam-like member 10 located under the seat and joined at each end to tubular side frame members (not visible in FIGS. 1 to 4), each of which is generally L-shaped in side elevation. The seat includes adjacent each side a sleeve that slides in telescoping relation over the bottom leg of the respective L-shaped frame member and is spring-loaded to a rearward position (as shown). The back 14 of the chair is connected to the upper ends of the two side frame members by mechanisms which allow the back to tilt backwardly, independently of the seat, the mechanisms having spring-loaded components that hold the back in an upright position but yield and allow backward tilting when a person sitting in the chair leans back.

Figure 1:
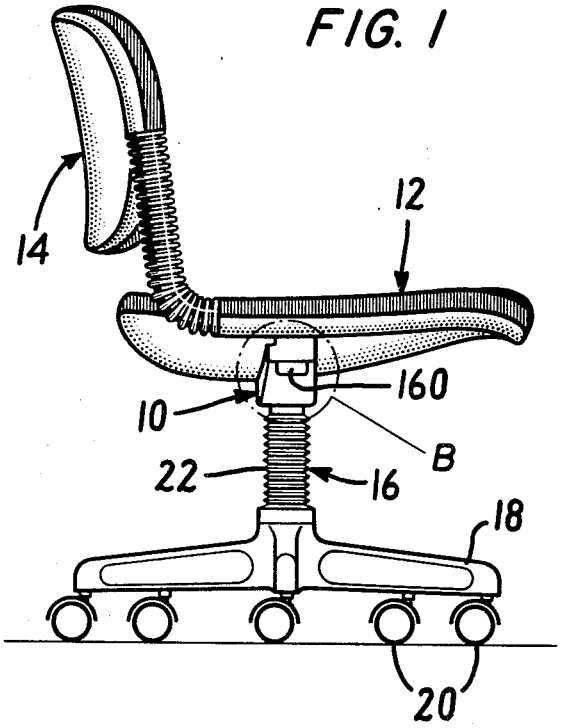
FIGS. 1 and 2 are side and front elevational views, respectively, of chairs embodying the present invention shown in the neutral position of the seat.
Figure 2:
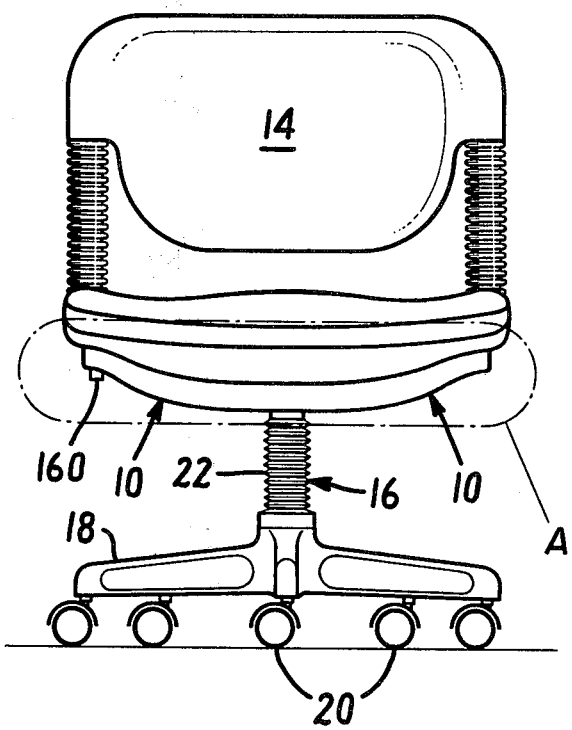
Figure 3:
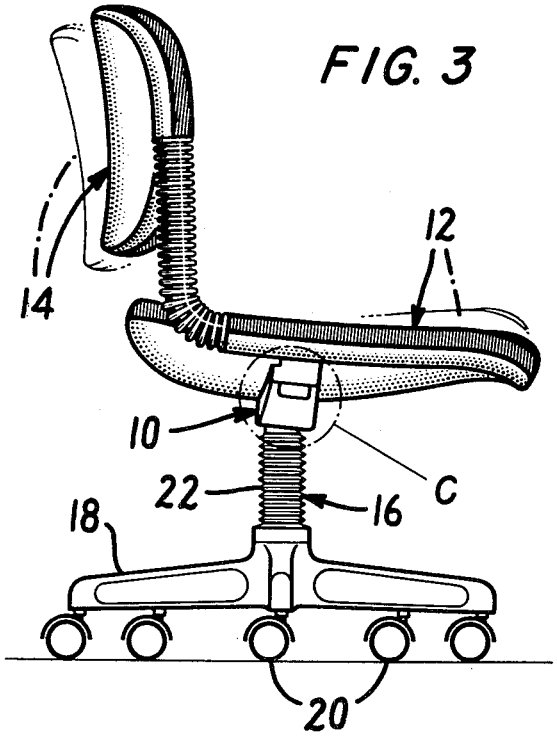
FIGS. 3 and 4 are side elevational views of the chair shown in FIGS. 1 and 2 in the tilt forward and tilt backward positions, respectively.

The present invention involves not only the mounting of a chair of the type described and shown in the prior application referred to above but to mounting the seat of any chair on a base in a manner that allows the seat to tilt forward, i.e., to assume a forward rake in which the front end of the seat is substantially below the rearward end and the seat is oriented at an angle at about 4½° forward rake to the horizontal (See FIG. 3). Therefore, the particular structure of the chair shown in FIGS. 1 to 4 is merely exemplary and is not a part of the present invention.

Figure 4:
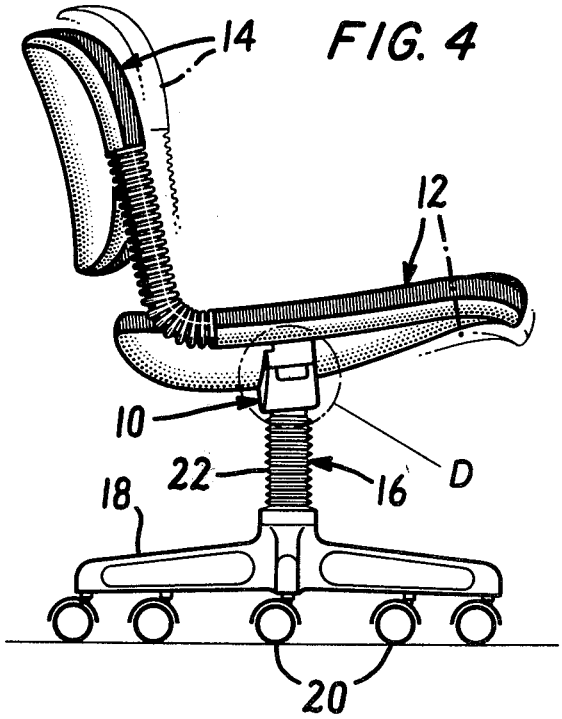

In certain of the embodiments described below, the seat mount mechanism by which the seat is mounted on the base also permits the seat and back to be tilted as a unit rearwardly (i.e., to assume a rearward rake in which the front of the seat is substantially above the back of the seat, see FIG. 4). The phantom lines in FIGS. 3 and 4 show the neutral position of the seat, which is also the position of the seat shown in FIG. 1. In the chair shown in FIGS. 1 to 4, the back and seat pivot as a unit to the tilt forward or tilt backward positions.

The chair shown in FIGS. 1 to 4 has a caster base 16 consisting of a post 22 and five legs 18, each of which has a caster 20. The corrugated form of the post shown in FIGS. 1 to 4 is a decorative, non-functional aspect of the post that is included to match aesthetically the flexible, extensible corrugated coverings that extend between the sleeves on the seat 12 and the sides of the back, as described and shown in detail in the prior application previously referred to. The structural post of the chair may be in any suitable form, and the connection between the post 22 and the legs 18 can be such as to allow the height of the chair seat 12 to be adjusted, or the post may include an adjustable, lockable gas spring for height adjustment.

FIGS. 5 to 22 show five embodiments of the seat mount mechanism by which the beam-like member 10 or any suitable form of bracket connected to the underside of a chair seat is attached to a post or other support for the chair, i.e., the structure enclosed within the phantom lines labelled A, B, C and D in FIGS. 1 to 4. In all embodiments shown in FIGS. 5 to 22 of the drawings, the seat mount mechanism comprises certain essential components, as follows:

(1) A bracket 30 which is connected to the seat and is positioned at approximately the center of the underside of the seat;

(2) A mounting plate which is affixed to the upper end of a post 22 or to any form of leg or post structure on which the seat is mounted;

(3) An axle which connects the bracket to the mounting plate in a manner that permits the bracket to pivot relative to the mounting plate;

(4) At least one spring (or set of springs) acting between the bracket and the mounting plate to yieldably restrain pivotal movements of the bracket relative to the mounting plate about the axis of the axle; and (5) Co-engaging stop surfaces on the bracket and mounting plate for limiting the extent of tilting movement of the bracket (and thus of the seat).

Figure 5:
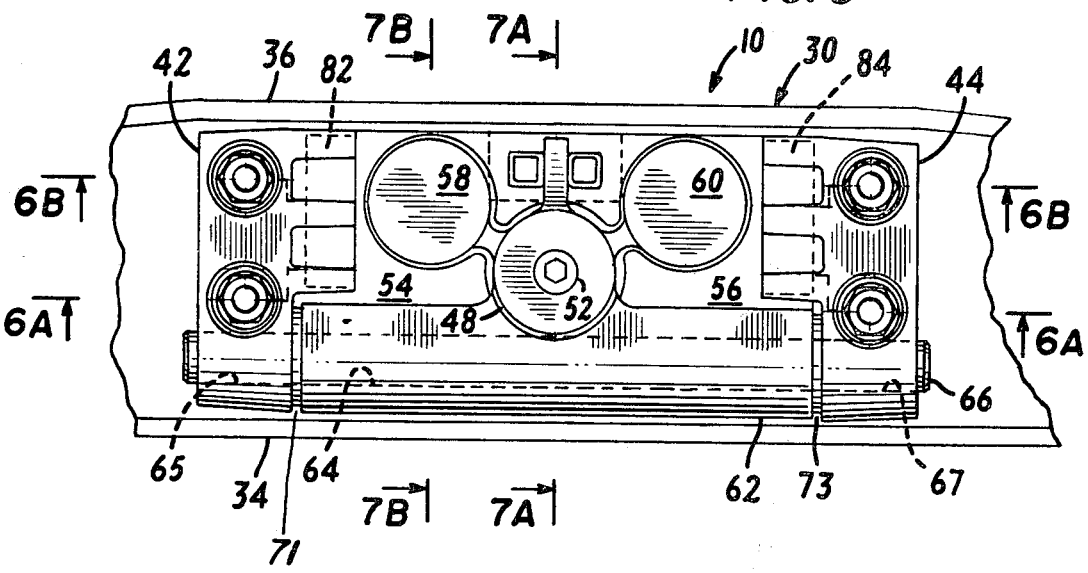
FIG. 5 is a top view of a seat-mount that provides for only forward tilting of a chair seat.
Figure 6A:
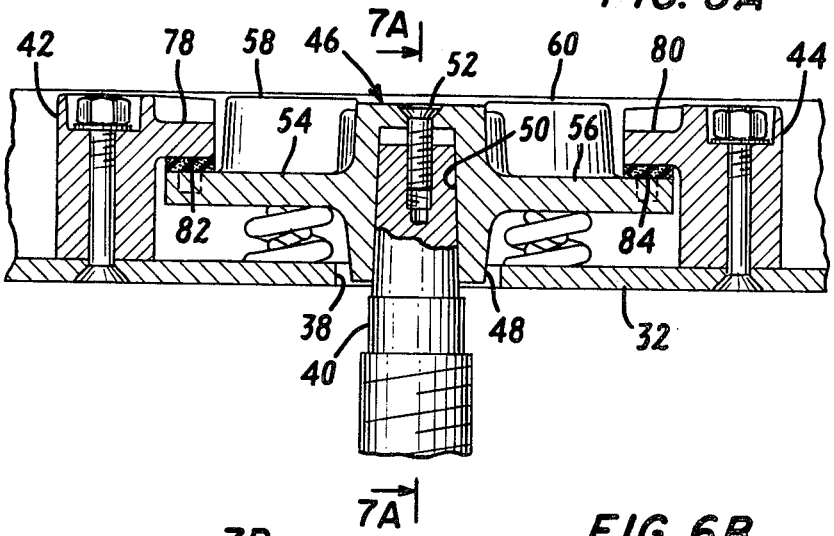
FIGS. 6A and 6B are cross-sectional views of the mount shown in FIG. 5 taken generally along the lines 6A and 6B of FIG. 5, respectively.
Figure 6B:
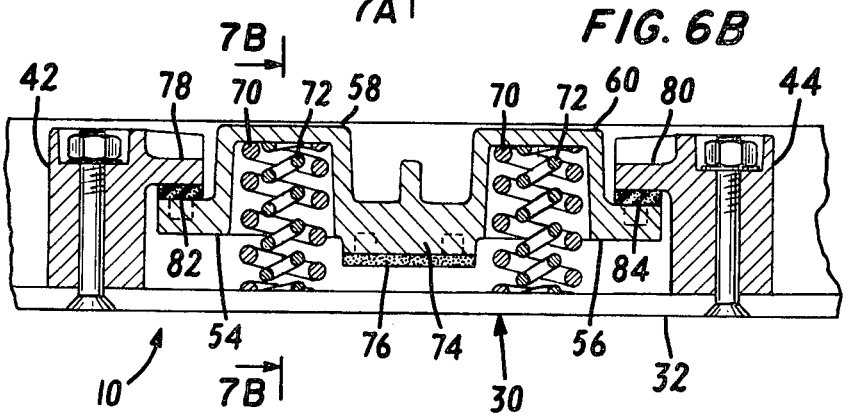
Figure 7A:
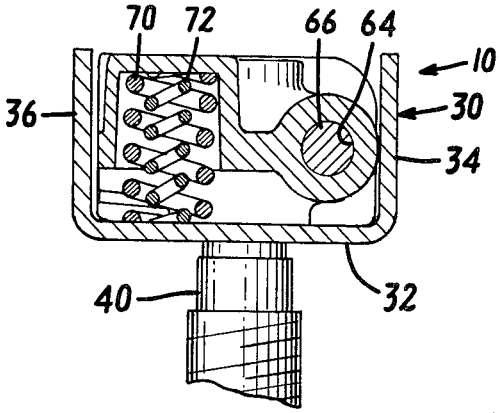
FIGS. 7A and 7B are cross-sectional views of the mount of FIG. 5 taken along the lines 7A and 7B, respectively.
Figure 7B:
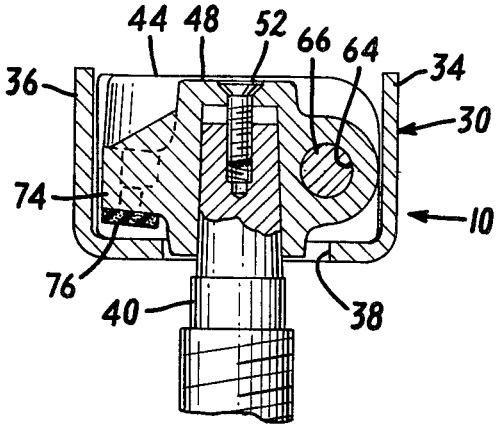
Figure 7C:
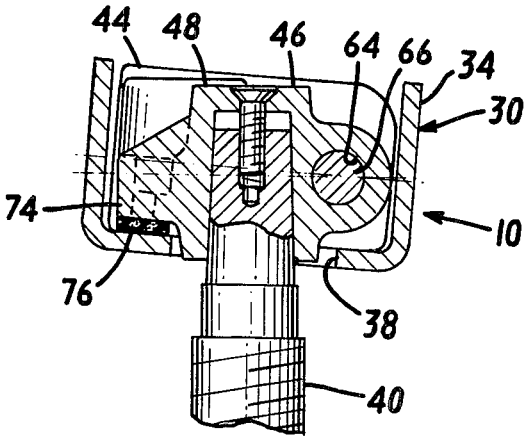
FIG. 7C is an end cross-sectional view of the mount of FIG. 5 taken along the line 7B of FIG. 5 but showing the mechanism in the tilt-forward position.

Referring to FIGS. 5 to 7 of the drawings, the bracket 30 includes the center part of the beam-like member 10 (FIGS. 1 to 4) by which the side frame members are interconnected and supported and in turn support the seat. The beam-like member 10 extends almost the entire width of the chair and is curved to conform generally to the contour of the underside of the chair, but for purposes of the present invention, the bracket need extend widthwise of the seat only a fraction of the total seat width. As is apparent from FIGS. 7A to 7C, considered in conjunction with FIGS. 1 to 4, the beam-like member 10 is "U" or channel-shaped in cross section and consists of a web portion 32 and a pair of upwardly extending legs 34 and 36. The web portion 32 has a hole 38 in the center for reception of the upper end 40 of the post (see FIG. 7B). The bracket 30 also includes a pair of upwardly extending axle holders 42 and 44, each of which is bolted to the web portion 32 of the bracket 30.

The mounting plate 46 of the mechanism shown in FIGS. 5 to 7 has a central boss 48 that is formed with a downwardly facing socket 50 which receives the upper end 40 of the post. A screw 52 through the head of the boss secures the mounting plate tightly to the post 40. Flanges 54 and 56 extend generally transversely out from opposite sides of the boss 48, each flange 54, 56 having a downwardly facing dome-like spring retainer cup 58, 60 located in the rearward portion. A horizontal, transversely elongated boss 62 extends across the front portion of the mounting plate 46 and has a horizontal hole 64 through it, the hole 64 being an axle-engaging surface, as that term is used herein. The bracket 30 is connected to the mounting plate 46 by an axle 66 which extends through the hole 64 and through registering holes 65 and 67 in the axle holders 42 and 44 of the bracket. Split rings 71 and 73 retain the axle in the hole 64 and serve as thrust washers between the bracket and mounting plate.

Springs 70 and 72 installed under compression between the top walls of the cups 58 and 60 and the web portion 32 of the bracket push down against the rear part of the web portion 32 of the bracket and restrain the bracket against pivoting forward about the axle 66 (see FIGS. 7A and 7B). However, when a person sitting in a chair leans forward, the springs 70 and 72 yield to the resulting change in the location of the center of gravity of the person, and the bracket, and therefore the seat, tilt to a forward rake position (see FIGS. 3 and 7C) by pivoting about the axle 66. When the person leans back again, the bracket, and therefore the seat, return to a neutral position (see FIGS. 1 and 7B).

The limit of forward rake of the seat is established by engagement between the lower wall of a rearwardly projecting flange 74 on the mounting plate 46 (see FIG. 7C) and the part of the web portion 32 of the bracket opposite the flange, a rubber cushion 76 being installed on the stop surface of the flange 74. The neutral or normal position of the bracket relative to the mounting plate is established by engagement between downwardly facing stop surfaces provided by in-turned flanges 78 and 80 on the axle holders 42 and 44 (see FIG. 6A) and the ends of the flanges 54 and 56 of the mounting plate 46, rubber cushions 82 and 84 being mounted on the flanges 54 and 56 to absorb and quiet the impact of engagement of the co-engaging stop surfaces.

It should be apparent from careful study of the drawings, in conjunction with the above description, that the mounting of the chair frame on the pedestal involves first placing the transverse beam-like member 10 (i.e., the bracket 30) loosely over the post 40, installing the mounting plate 46 on the post (with the springs and axle in place) and then installing the axle holders 42 and 44, a suitable clamp being used to pre-load the springs and hold the parts together while the axle holders 42 and 44 of the bracket are being bolted to the web portion 38.

Figure 8:
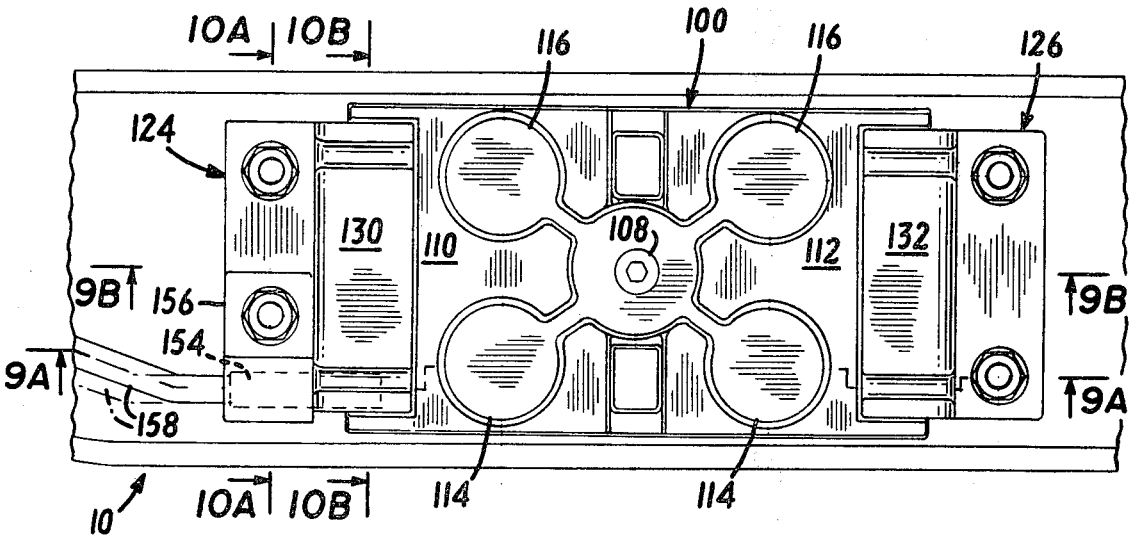
FIG. 8 is a plan view of an embodiment of a mount that affords both forward and backward tilting of a chair seat.

The mechanism shown in FIGS. 8 to 10 comprises a mounting plate 100 having a central boss 102 formed with a downwardly opening socket 104 that receives the upper end of the post 106 of the pedestal support of the chair, the mounting plate 100 being affixed to the post 106 by a screw 108. A generally horizontally oriented flange 110, 112 extends transversely out from each side of the central boss 102. Each flange 110 or 112 is formed with a pair of spaced-apart, downwardly open cups 114 and 116, each of which receives and retains in place the upper ends of two springs 118 and 120.

(In some of the embodiments shown in the drawings, two springs are provided in each spring position; a cluster of a smaller spring within a larger spring at each spring position provides the required restraining forces between the bracket and mounting plate, notwithstanding the relatively small lever arms involved in the various mechanisms, within a relatively small volume of space and with significant savings in weight and cost.)

Figure 9A:
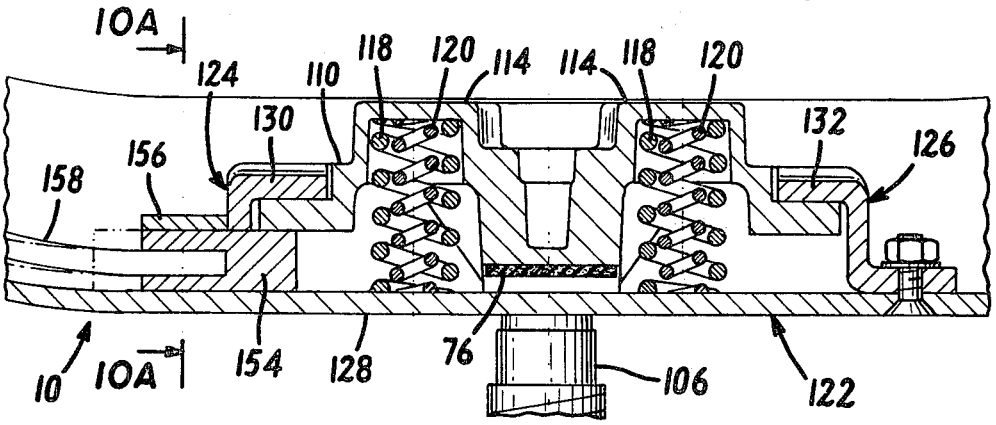
FIGS. 9A and 9B are front cross-sectional views of the mount of FIG. 8 taken along the lines 9A and 9B of FIG. 8.
Figure 9B:
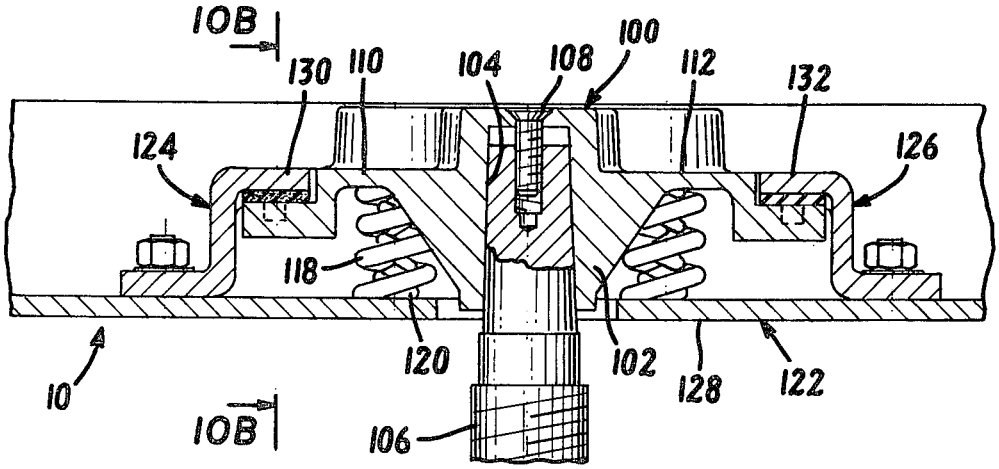

The bracket 122 of the mechanism of FIGS. 8 to 10 is, as in the embodiment of FIGS. 5 to 7, constituted in part by the center portion of the beam-like member 10 of the chair frame. The bracket 122 is supported by the mounting plate 100 by means of a pair of axle holders 124 and 126, each of which is bolted to the base portion 128 of the bracket 122. The two axle holders 124 and 126 are identical, each being generally Z-shaped as viewed from the front (see FIG. 9B) thus to provide a top flange portion 130, 132, which portion has, as may best be seen in FIG. 10B, front and back downwardly concave ribs 134 and 136. The outer end of each of the flanges 110 and 112 of the mounting plate 100 is formed with upwardly concave axle-supporting surfaces 138 and 140 which register with and receive the respective ribs 134 and 136. The ribs 134 and 136 serve as axles about which the bracket part of the mechanism pivots relative to the mounting plate.

Figure 10A:
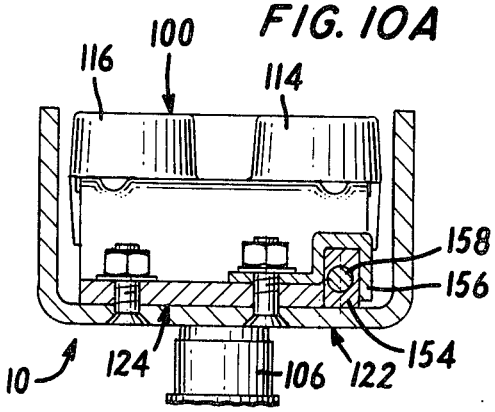
FIG. 10A is a cross-sectional view of the mount of FIG. 8 taken along the lines 10A of FIG. 8.
Figure 10B:
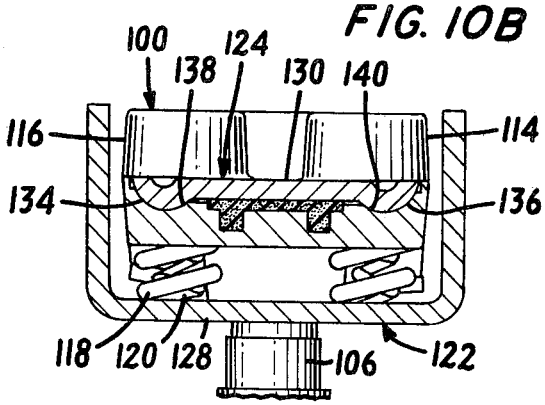
FIGS. 10B, 10C and 10D are cross-sectional views of the mount of FIG. 8 taken along the lines 10B of FIG. 8 and illustrating the mechanism in the neutral and in the forward and rearward tilt positions, respectively.
Figure 10C:
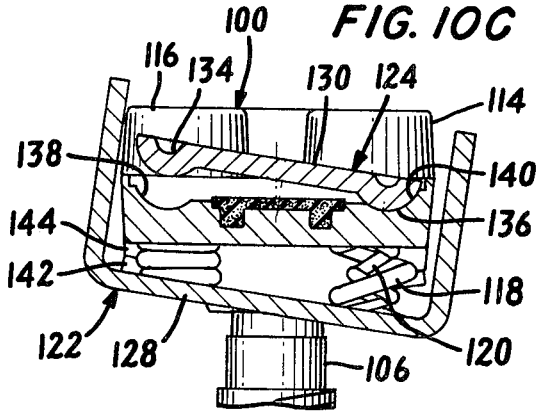

More particularly, as illustrated in FIG. 10C of the drawings, if a person sitting in the chair leans forward, the shifting of his center of gravity to a more forward position imposes a force on the seat sufficient to overcome the spring force in the rear set of springs engaged between the mounting plate 100 and a bracket 122, thus tilting the bracket to the position shown in FIG. 10C. Such tilting involves pivoting of the bracket assembly (consisting of the beam-like member 10 and the two axle holders 124 and 126) about the front ribs or axles 136 of the two axle holders. The extent of forward tilting of the seat is limited by engagement of the base portion 128 immediately behind the post 106 with a rubber cushion 142 installed on a rear flange 144 formed on the mounting plate 100.

Figure 10D:
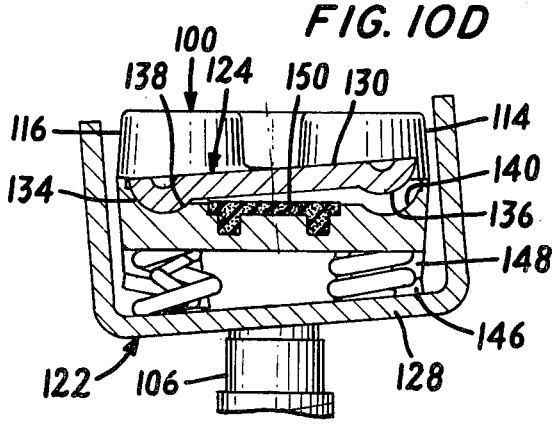

If the person sitting in the chair leans back to relax, the shifting of his center of gravity to the rear will cause the seat to tilt backward, such tilting being afforded by an overriding of the spring force of the front set of springs and by pivoting of the bracket relative to the mounting plate about the back ribs or axles 134 (see FIG. 10D). The maximum rearward rake of the seat is established by engagement of the base portion 128 of the bracket 122 with a rubber cushion 146 secured to the bottom surface of a front stop flange 148 formed on the mounting plate immediately in front of the post 106. The reseating of the upper flanges 130 and 132 of the axle holders 124 and 126 on the flanges of the mounting plate 100 is cushioned by rubber pads 150 installed on top of each flange 110 and 112 under the center parts of the top flanges 130 and 132 of the axle holders 124 and 126.

If it is desired to prevent the chair seat from tipping rearward in the manner just described, that can be done by moving a blocking member 154 (see particularly FIGS. 9A and 10A) into a position under the flange 110 of the mounting plates 100 and the base portion 128 of the bracket 122. This prevents the bracket from tilting backwardly relative to the mounting plate. The blocking member 154 is retained within a guide clip 156 bolted to the bracket (see FIG. 10A) and is connected to the end of an operating rod 158 that extends laterally out within the beam-like member 10 of the chair to a point near the end of the member. A handle 160 (see FIGS. 1 and 2) on the end of the rod 158 permits the user to move the blocking member 154 into and out of blocking position, and thus the user is able to provide for or prevent rearward tilting of the chair at will and with ease.

Figure 11:
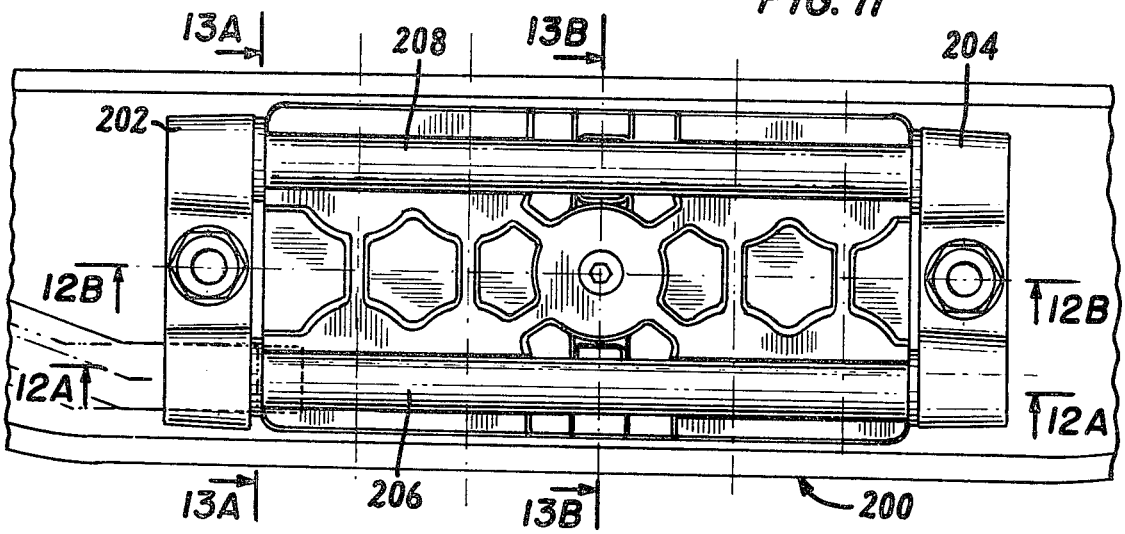
FIG. 11 is a top view of another seat mount mechanism.
Figure 12A:
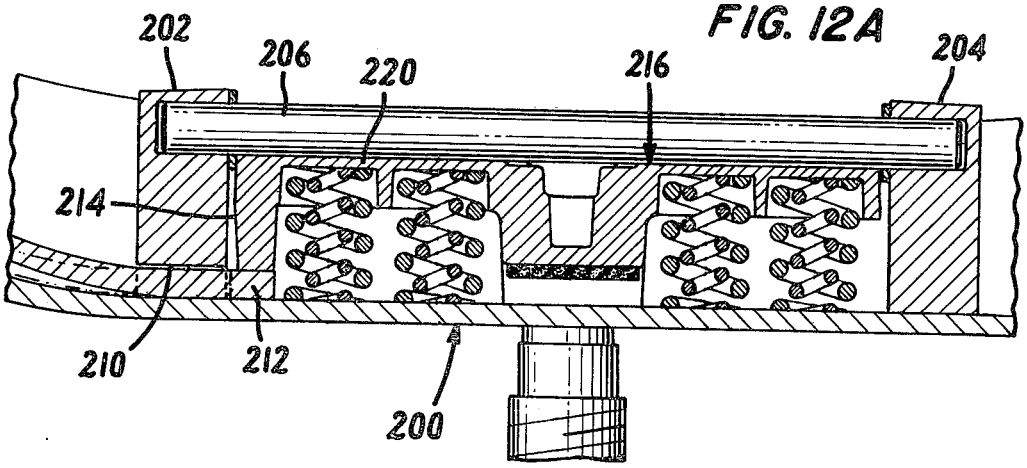
FIGS. 12A and 12B are front cross-sectional views of the mechanisms of FIG. 11 taken along the lines 12A and 12B, respectively.
Figure 12B:
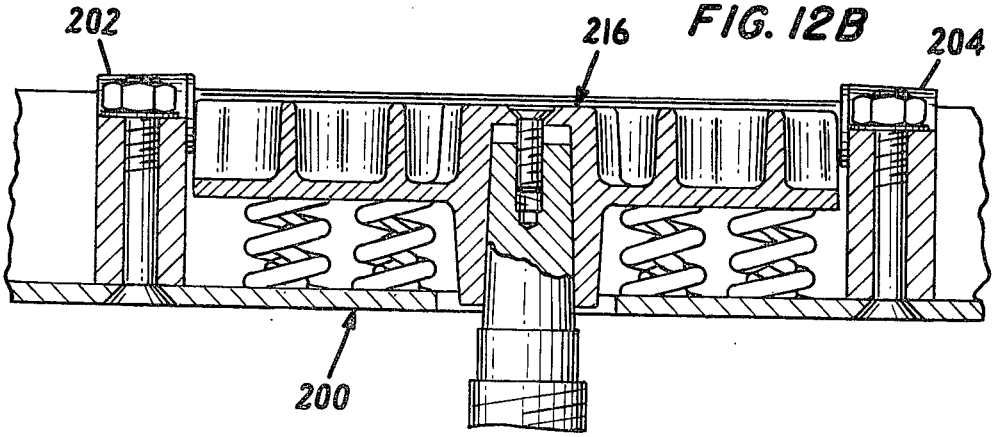
Figure 16A:
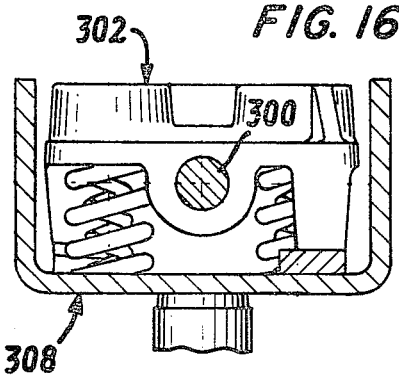
FIG. 16A is an end cross-sectional view of the mount of FIG. 14 taken along the lines 16A of FIG. 14.
Figure 13A:
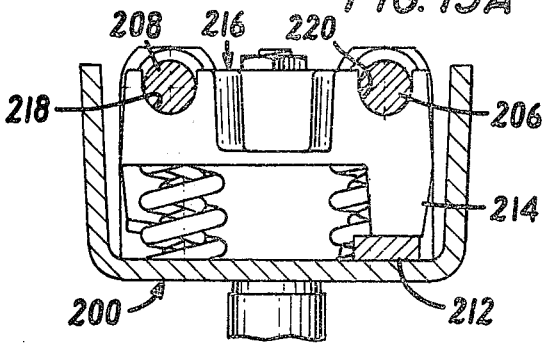
FIG. 13A is an end cross-sectional view of the mechanism of FIG. 11 taken along the line 13A of FIG. 11.
Figure 16B:
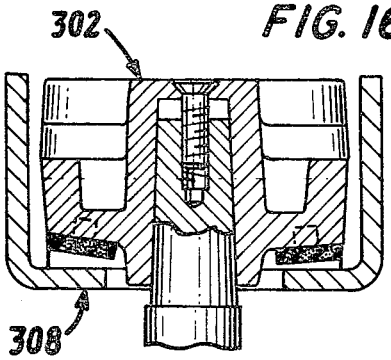
FIGS. 16B, 16C and 16D are end cross-sectional views taken along the line 16B of FIG. 14 and showing the mechanism in the neutral, forward tilt, and rearward tilt positions, respectively.
Figure 13B:
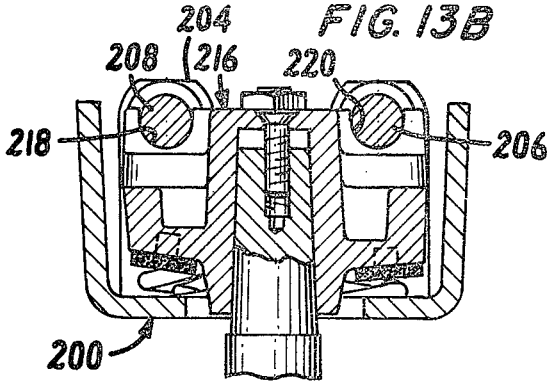
FIGS. 13B, 13C and 13D are end cross-sectional views of the mechanism of FIG. 11 taken along the line 13B of FIG. 11 and illustrating the mechanism in the neutral, forward tilt, and rearward tilt positions, respectively.
Figure 16C:
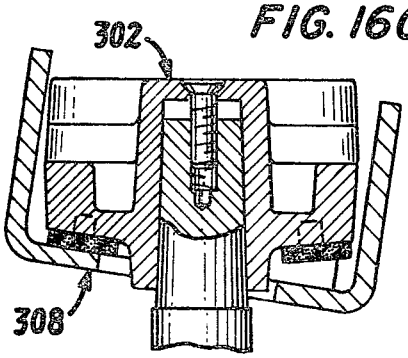
Figure 13C:
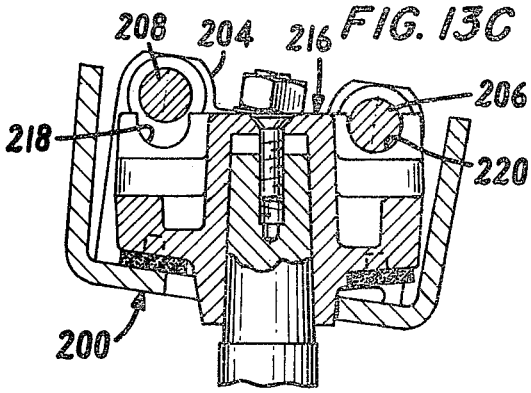
Figure 16D:
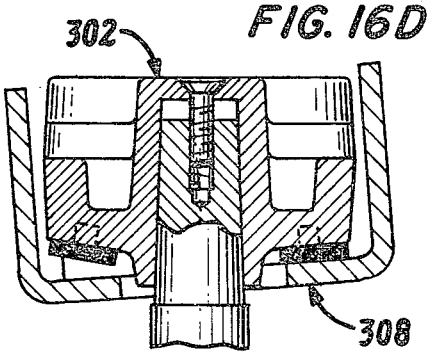
Figure 13D:
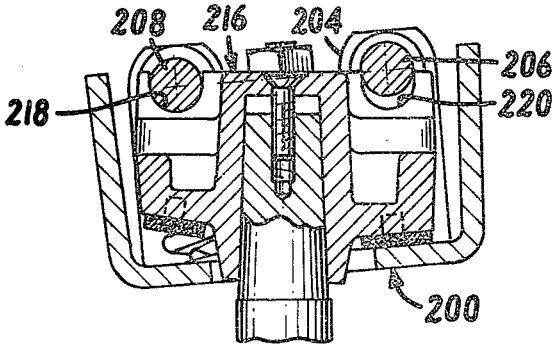

The mechanism of FIGS. 11 to 13 is similar in both structure and mode of operation to that shown in FIGS. 8 to 10, and, therefore, given the above detailed description, a brief description here is sufficient. The bracket 200 of FIGS. 11 to 13 is the same as that of FIGS. 8 to 10 except that the axle holders 202 and 204 are metal blocks, each of which has a front hole and a rear hole that receives one end of an axle 206 or 208. The left axle holder 202 has a notch 210 in its bottom edge which serves as a guide for a blocking member 212, the blocking member being attached to the end of an operating rod and leading out to a handle as in the mechanism of FIGS. 8 to 10. The blocking member 212 prevents rearward tilting of the seat (see FIG. 13A) by filling a clearance between the base portion of the bracket 200 and a dependent flange 214 formed on the mounting plate 216.

The mounting plate 216 is in almost all respects the same as that in the mechanism of FIG. 8, except for the various details of geometry, such as the number and location of the springs. The principal difference is that the upper face of the bracket 216 has transversely continuous, upwardly open grooves of semi-circular cross section that extend entirely across the mounting plate, the grooves constituting axle-engaging surfaces and being designated by the reference numerals 218 and 220. The front and rear stops are the same as in the mechanism of FIGS. 8 to 10.

The mode of operation of the mechanism of FIGS. 11 to 13 is exactly the same as the embodiment of FIGS. 8 to 10.

Figure 14:
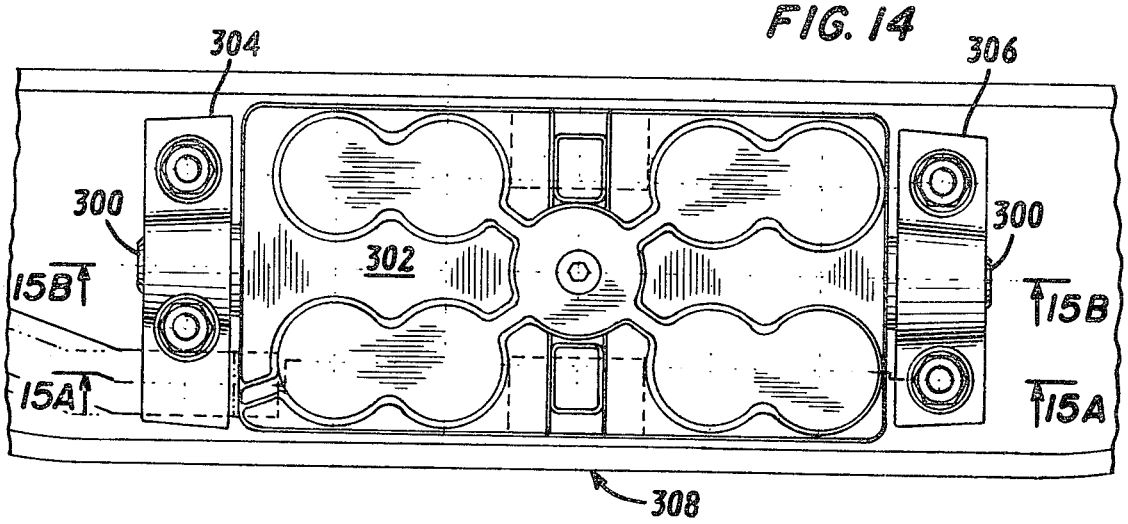
FIG. 14 is a plan view of another seat mount embodying the invention.
Figure 15A:
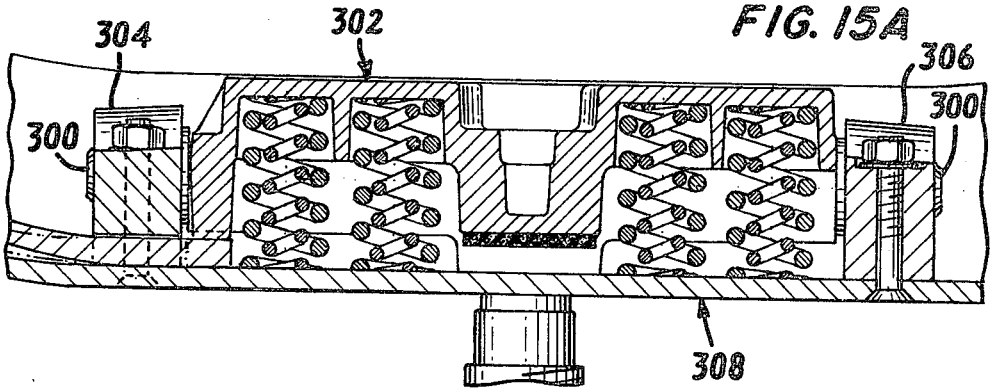
FIGS. 15A and 15B are front cross-sectional views of the mount of FIG. 14 taken along the lines 15A and 15B of FIG. 14.
Figure 15B:
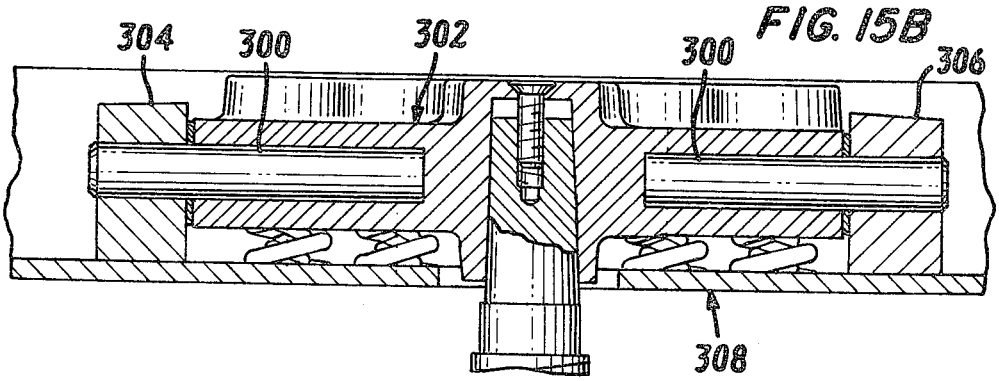
Figure 17:
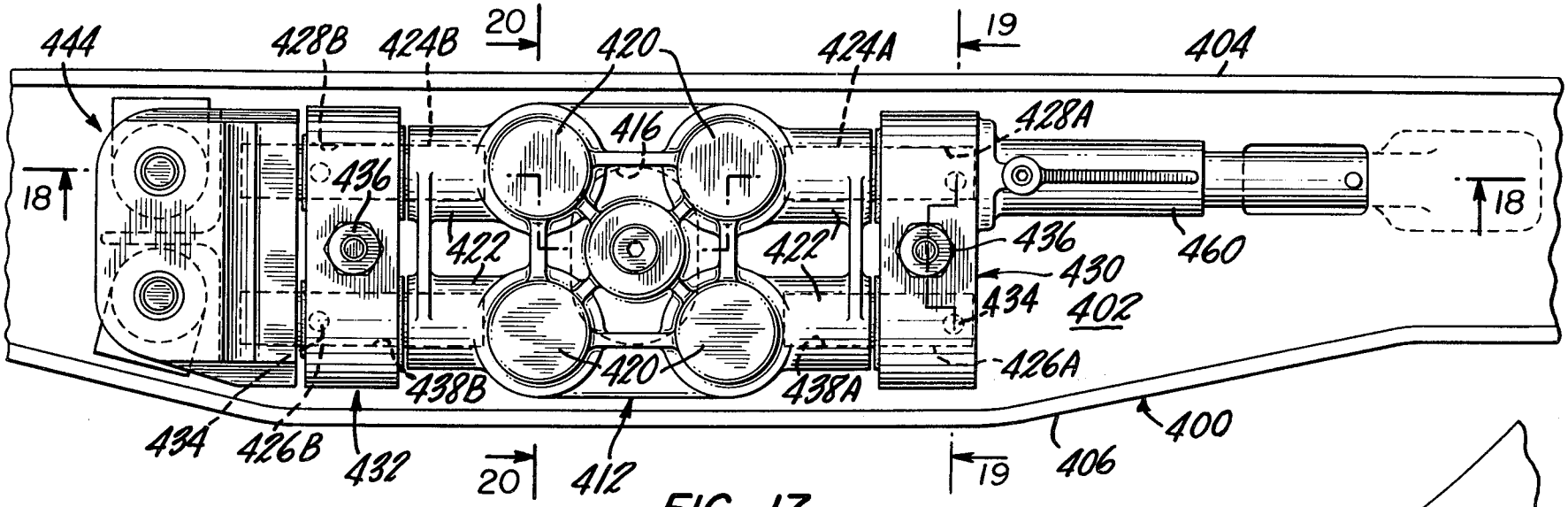
FIG. 17 is a top view of another embodiment of the seat mount.
Figure 18:
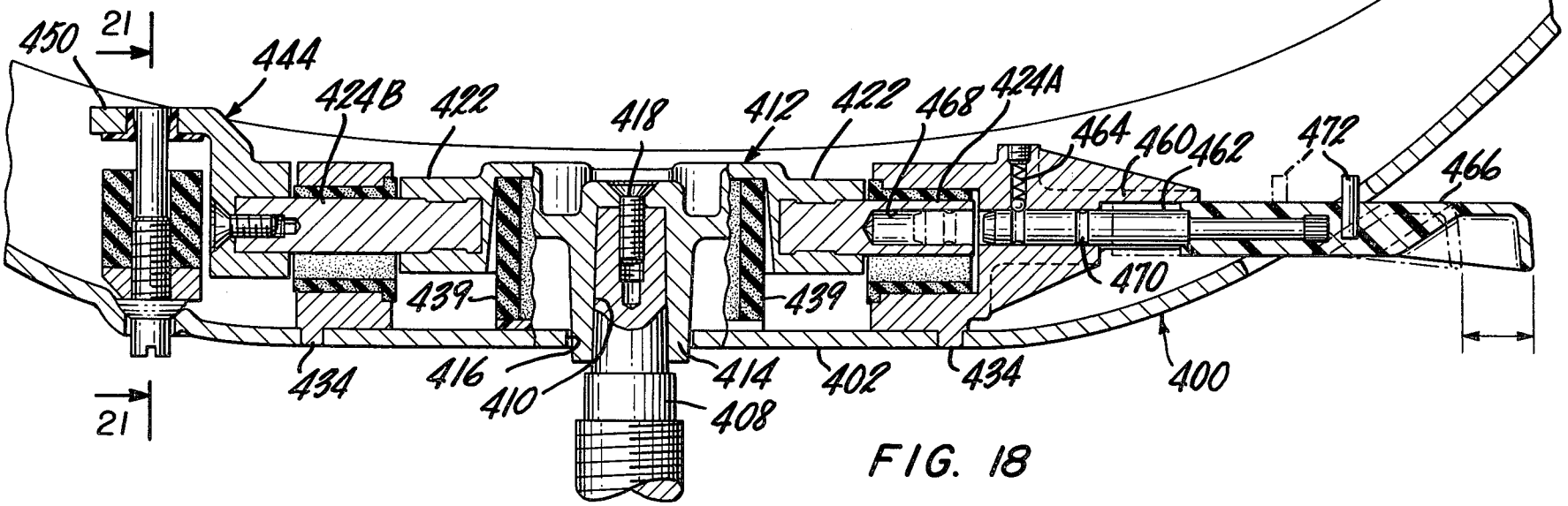
FIG. 18 is a rear cross-sectional view of the seat mount of FIG. 17 taken generally along a broken plane represented by the lines 18—18 of FIG. 17 and in the direction of the arrows.
Figure 19:
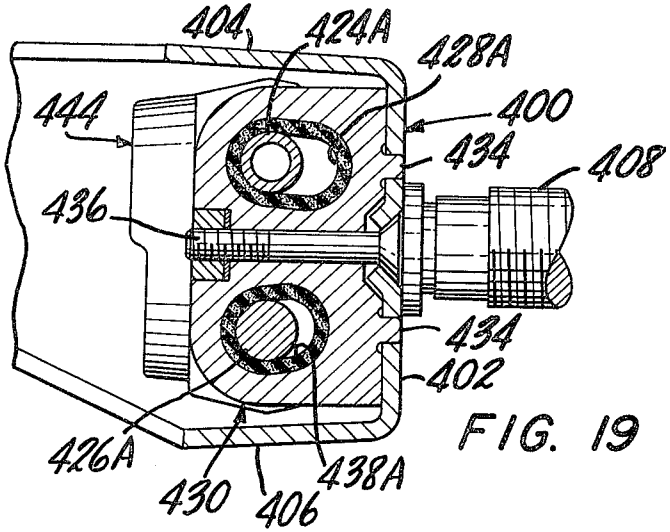
FIG. 19 is an end cross-sectional view of the seat mount of FIG. 17 taken along the lines 19—19 of FIG. 17.
Figure 20:
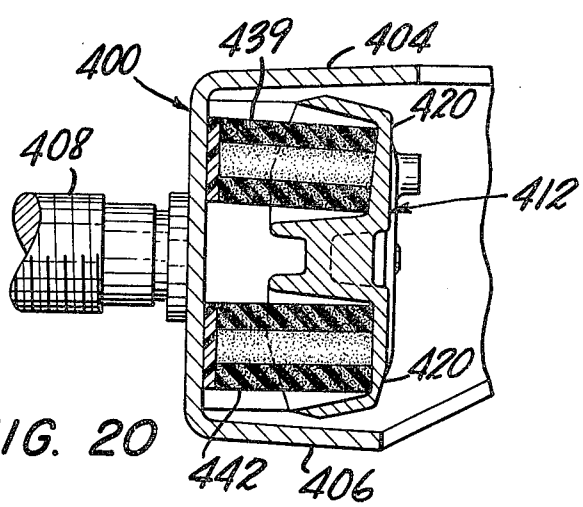
FIG. 20 is an end cross-sectional view taken along the lines 20—20 of FIG. 17.
Figure 21A:
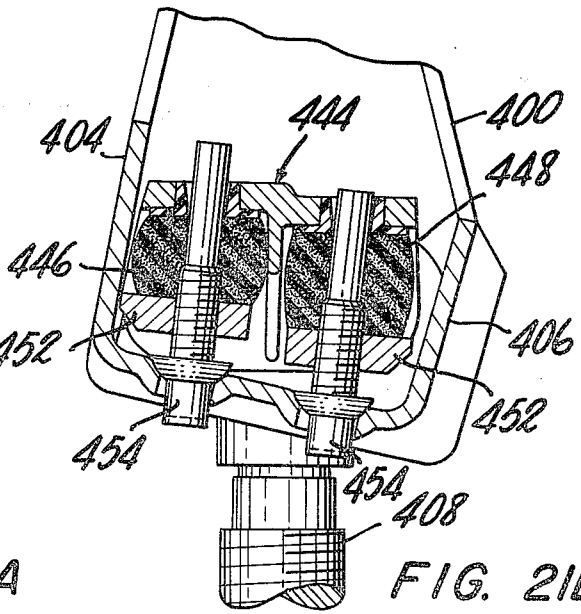
FIGS. 21A, 21B and 21C are end cross-sectional views taken along the lines 21—21 of FIG. 18 and showing, respectively, the mount in the neutral, rearward tilt, and forward tilt positions.
Figure 21B:
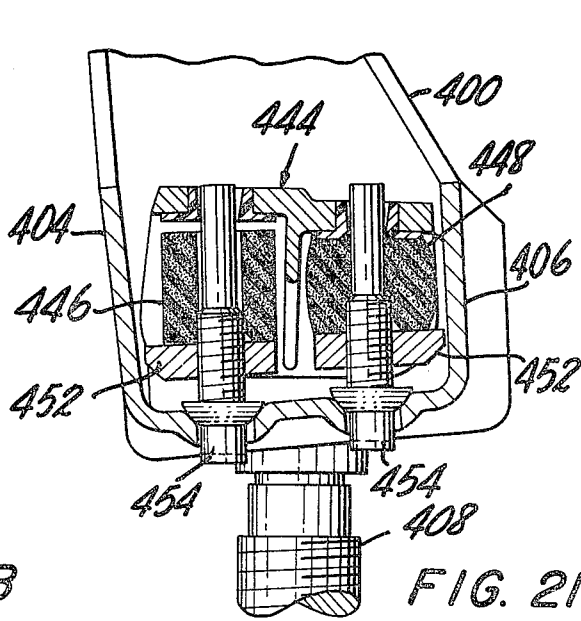
Figure 21C:
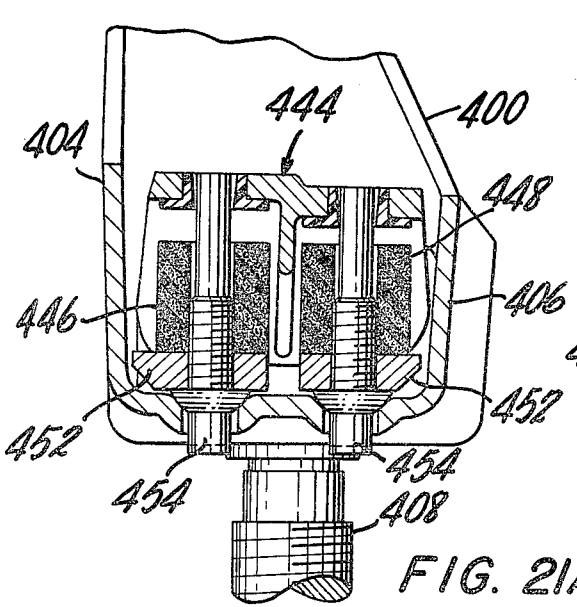

The embodiment shown in FIGS. 14 to 16 of the drawings, like the mechanisms of FIGS. 8 to 13, is constructed to permit both forward and rearward tilting, but rather than having two axles, one for forward tilting and one for rearward tilting, the embodiment of FIG. 14 includes a single axle, albeit a single axle consisting of two separate segments 300, each of which is received in a flange of the mounting plate 302 and in an axle holder 304 or 306 of the bracket 308. The arrangement of the springs, the attachment of the mounting plate 302 to the post, the structure and operation of the stops and the blocking of rearward tilting are not materially different in either structure or mode of operation from the above-described embodiments, except that both rearward and forward tilting are about the transverse horizontal common axis of the two axle components 300.

Of the embodiments shown in the drawings which involve both rearward and forward tilting, the embodiment shown in FIGS. 17 to 22 represents the base mode. The bracket 400 is virtually identical to the brackets of the above-described embodiments in that it is generally U-shaped in cross section and includes a web portion 402, and front and rear leg portions 404 and 406. The post 408 of a pedestal base is received in a socket 410 of the mounting plate 412, the lower part of the boss 414 in which the socket 410 is formed extending out through a hole 416 in the web 402 of the bracket. The mounting plate 412 is rigidly secured to the upper end of the post 408 by a screw 418.

The mounting plate 412 includes four cup-like flanges 420 and two pairs of laterally projecting, generally cylindrical bosses 422. To minimize the weight of the mounting plate, the boss 414, flanges 420 and the bosses 422 are joined by various stiffening webs; the mounting plate 412 is perferably an aluminum or steel casting. A front axle composed of segments 424A and 424B and a rear axle composed of segments 426A and 426B (see FIG. 18) are cast in place in the mounting plate and extend laterally outwardly from the respective bosses 422. The axles are parallel to each other and extend transversely with respect to the chair seat.

The ends of the front axle segments 424A and 424B are received in oblong cavities 428A and 428B in a pair of fittings 430 and 432 which are rigidly joined to, and thus are parts of, the bracket and which are located adjacent each side of the mounting plate 412. Each of the fittings 420 and 432 is fixed in position on the bracket by locating pins 434 and secured in place by a bolt 436. The ends of the rear axle segments 426A and 426B are received in rear cavities 438A and 438B in the fittings 430 and 432, respectively. Each cavity is lined with an elastomeric bushing which cushions and quiets engagements between the respective axle segments and the cavities in the operation of the seat mount.

In the neutral position of this embodiment (see FIGS. 19 and 22A), the bracket hangs from the mounting plate by means of supporting engagement between the tops of all of the axle segments and all of the cavities. When a person sitting in the chair leans backward (FIG. 22B), the bracket pivots rearwardly about the rear axle segments 426A and 426B, and the front part of the bracket lifts up relative to the back part, thus disengaging the tops of the front axle segments 424A and 424B and the front cavities 428A and 428B. The limit of rearward tilting is established by engagement between the bottom of the front axle 424 and the front cavities 428, the position shown in FIG. 22B. Rearward tilting of the bracket relative to the mounting plate is yieldably restrained by a pair of front compression springs 439 which are interposed between the web 402 of the bracket and the cup-like flanges of the mounting plate forwardly of the rear axle. All of the springs of the mount of FIGS. 17 to 22 are elastomer cylinders (e.g., polypropylene of about 90, "A" scale, Shore hardness), the lower ends of which are bonded to a hard polymer washer (e.g., polypropylene).

Figures 22A, 22B, 22C:
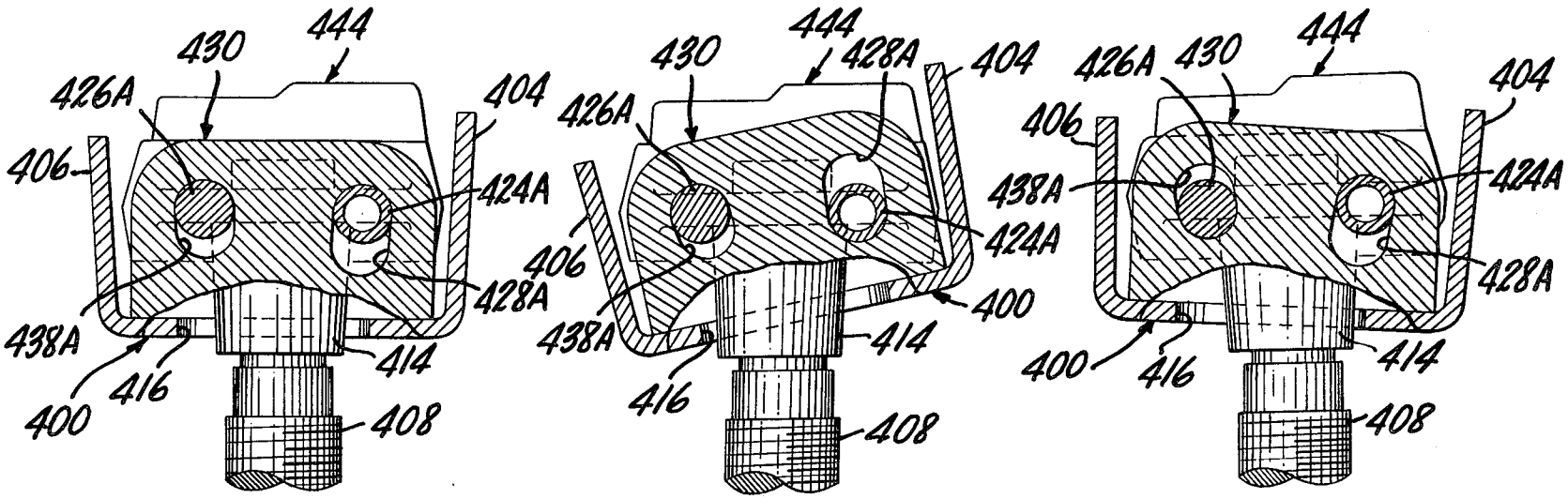
FIGS. 22A, 22B and 22C are schematic end cross-sectional views taken generally along the lines 19—19 of FIG. 17 and showing the seat mount in the neutral, tilt rearward and tilt forward positions, respectively.

When a person sitting in the chair leans forward, the seat automatically tilts forward by pivoting of the bracket about the front axle 424 and lifting of the rear part of the bracket, relative to the front part, which results in disengagement of the rear cavities 438 from the rear axle 426 (see FIG. 22C). Forward tilting is yieldably restrained by a pair of rear springs 442 interposed between the mounting plate and the web portion 402 of the bracket in a position rearwardly of the front axle. The limit of forward tilting, as shown in FIG. 22C, is established by engagement between the undersides of the rear axle and the bottoms of the rear cavities 438 of the bracket.

As an optional but preferred feature of the mount of FIGS. 17 to 22, adjustable springs are incorporated. In particular, a bracket 444 is fastened to the mounting plate by way of the axle segments 424B and 426B, and front and rear adjustable elastomeric springs 446 and 448 are interposed between a flange 450 of the bracket 442 and nuts 452 which may be driven up or down by adjusting screws 454, the heads of which are accessible from under the chair and are slotted to be driven by a screw driver. The nuts 452 are specially shaped and installed so that they engage the legs of the bracket, thus to prevent them from rotating while permitting them to be driven up or down. The upper ends of the adjusting screws are received in bushed holes in the flange 450 of the bracket 442, and the heads of the screws have spherical surfaces that seat in matching seats in the web portion of the bracket, thus to permit the screws to rock as the bracket pivots. The bushings which guide the upper ends of the screws are tapered to permit rocking of the screws (see FIGS. 21B and 21C).

A second optional but preferred aspect of this embodiment is a mechanism for disabling the rearward tilt function of the seat mount. The fitting 430 has an integral, laterally extending barrel 460 which receives and guides a movable latch pin 462. When the latch pin is in the position shown in the solid lines in FIG. 18, the inner end is clear of the outer end of the front axle segment 424A, a spring-loaded ball detent 464 retaining the latch pin in the inoperative position. When the person sitting in the chair desires to disable the rearward tilt feature, he merely pushes in on an operating handle 466 that projects out through a hole in the web portion of the bracket, thereby to move the inner end of the latch pin into a socket 468 in the front axle segment 424A. This prevents the front part of the bracket from pivoting up relative to the mounting plate. The locking pin is held in the tilt-disabling, inward position by a second detent groove 470 on the pin. Should the detent be overrun when the pin is pushed toward the "in" position, the end of the pin will merely bottom out in the socket. Should the person override the detent in moving the pin in the "out" direction, a retainer pin 472 on the handle 466 will encounter the edge of the hole in the bracket and stop the locking pin from being entirely pulled out of the mechanism.

I claim:

1. A seat mount for supporting a chair seat on a base comprising a mounting plate rigidly secured to the base, a seat-supporting bracket located under generally the center of the seat and carrying the seat, a transverse axle joining the bracket and plate for tilting of the bracket and seat about an axis extending transversely of the seat, co-engageable stop surfaces associated with the bracket and plate and positioned relative to each other to engage and stop forward tilting when the seat is tilted to a forward rake position in which the front of the seat is located a substantial distance below the back of the seat and the seat is at an inclination of about 4½° to the horizontal, and at least one compression spring located rearwardly of the axis of the axle and engaged under compression between the bracket and mounting plate and yieldably restraining the bracket and thus the seat from tilting forward about the axis.

2. A seat mount according to claim 1, wherein the mounting plate includes a pair of generally horizontally and transversely oriented flange portions, each of which portions has at least one downwardly open spring retainer cup therein receiving said at least one compression spring, and the bracket has a generally horizontally and transversely oriented web portion located below the flanges opposite from the cups and engaged by the spring.

3. A seat mount according to claim 2, wherein the axle is connected to the bracket by a pair of transversely spaced-apart axle holders extending upwardly from the web portion, one such holder being adjacent each end of the mounting plate and receiving the axle.

4. A seat mount according to claim 3, wherein the stop means includes flanges on the axle holders of the bracket positioned to engage portions of the mounting plate.

5. A seat mount according to claim 2, wherein the co-engageable stop surfaces includes a portion of the web portion of the bracket and a portion of the mounting plate located opposite thereto for engagement in the forward tilting position.

6. A seat mount according to claim 1, wherein the bracket is generally U-shaped in end cross section and is oriented with the base thereof down and the legs up, and the spring, axle and mounting plate are received between the legs and above the base of the bracket for concealment and protection.

7. A seat mount according to claim 1, wherein the mounting plate includes a boss having a socket receiving a post on the support and a pair of flanges extending generally transversely and horizontally outwardly from the socket in opposite directions.

8. A seat mount according to claim 7, wherein each flange of the mounting plate includes a downwardly facing surface located opposite from and in spaced relation to a portion of the bracket, and wherein at least one spring is received under compression between each such surface and opposite portion.

9. A seat mount according to claim 8, wherein the mounting plate further includes a generally transversely and horizontally extending boss joined integrally to the socket boss and flanges.

10. A seat mount according to claim 9, wherein the axle-supporting surface is a hole extending through the transverse-horizontal boss.

11. A seat mount according to claim 1, and further comprising at least one second compression spring engaged under compression between the bracket and the mounting plate and positioned to provide yieldable restraint against rearward tilting of the seat from a neutral position and co-engageable stop surfaces associated with the bracket and mounting plate positioned to limit the extent of rearward tilting of the seat.

12. A seat mount according to claim 11 and further comprising means for selectively preventing rearward tilting of the seat from a neutral position and including a blocking member selectively movable into a space existing between the mounting plate and the bracket when the seat is in the neutral position.

13. A seat mount according to claim 1 and further comprising a second axle joining the plate and bracket for tilting about a second transverse horizontal axis spaced from and parallel to the aforementioned axis, and wherein each axle is disengageable from an axle-engaging surface on one of the brackets and plates when the seat tilts in one direction and engages such surface for pivotal support of the seat on the base when the seat tilts in the other direction, and further comprising at least one second compression spring engaged under compression between the bracket and the mounting plate and positioned to resiliently restrain rearward tilting of the seat about the second axle and stop means associated with the bracket and plate for limiting the extent of rearward tilting of the seat to a rearward rake position with the front end of the seat substantially above the back end of the seat.

14. A seat mount according to claim 13, wherein the first and second axles are joined to the bracket with their axes fixed relative to the bracket, wherein the mounting plate includes axle-engaging surfaces corresponding to each axle, each such surface being an upwardly facing concavity in the mounting plate, both of which receive the corresponding axles in nested relation when the seat is in a neutral position and each of which supports the corresponding axle when the seat is tilted in one direction while the other axle lifts up from engagement with its axle-engaging surface.

15. A seat mount according to claim 13, wherein the axles are joined to the plate with their axes in fixed positions relative to the plate and wherein the bracket includes axle-engaging surfaces corresponding to each axle, each such axle-engaging surface being a downwardly facing concavity on the bracket, both axles engaging their corresponding axle-engaging surfaces when the seat is in a neutral position and each axle engaging its corresponding axle-engaging surface when the seat tilts in one direction while the axle-engaging surface corresponding to the other axle lifts up out of engagement with such other axle.

16. A chair according to claim 13, wherein the mounting plate includes a generally centrally located boss having a socket which receives a post on the support, and a pair of flanges extending generally horizontally and transversely out from the boss in opposite directions.

17. A chair according to claim 16, wherein the bracket includes a web portion located under the flanges of the mounting plate, and the compression springs are engaged between the web portion of the bracket and the flanges of the mounting plate.

18. A chair according to claim 17, wherein the co-engageable stop surfaces are located generally rearwardly of the socket and consist of a rearwardly extending flange portion of the boss of the mounting plate and a part of the web portion of the bracket located opposite thereto.

19. A chair according to claim 18, wherein the stop means consists of a forwardly extending flange portion on the boss of the mounting plate and a part of the web portion of the bracket located opposite thereto.

20. A chair according to claim 13, and further comprising means for selectively preventing rearward tipping of the seat from the neutral position including a blocking member selectively movable into a space existing between the mounting plate and the bracket when the seat is in the neutral position.

21. A chair according to claim 17, wherein one flange of the mounting plate includes a downwardly extending lug adjacent the forward edge and the free end, the lower end of the lug being spaced from the web portion of the bracket when the seat is in a neutral position, and further comprising a blocking member movable selectively into the space between the lower end of the lug and the web portion of the bracket selectively to prevent rearward tilting of the seat from the neutral position.

22. A chair according to claim 17, wherein the bracket includes an axle holder extending up from the web portion adjacent the free end of each flange, the axles being connected to the axle holders.

23. A chair according to claim 22, wherein each axle holder includes a flange portion extending inwardly to overlie a portion of the adjacent flange of the mounting plate, each such flange having a pair of downwardly convex ribs on its underside, such ribs being the axles about which the bracket and the seat tilt.

24. A chair according to claim 15, wherein the axle-engaging surfaces of the bracket are portions of cavities on the bracket, and the stop surfaces and stop means are upwardly facing parts of the cavities and downwardly facing parts of the respective axles, which parts engage when the cavity moves up as the bracket pivots about the other axle.

25. A chair according to claim 1, wherein an end of the spring engages an adjustable abutment thus to afford changing the degree of restraint such spring affords against tilting of the seat.

26. A chair according to claim 1, wherein the spring is an elastomeric body.

27. A seat mount for supporting a chair seat on a base comprising a mounting plate rigidly secured to the base, a seat-supporting bracket located under generally the center of the seat and carrying the seat and including a web portion located under the mounting plate, spaced-apart front and rear transverse horizontal axles joined to the mounting plate with their axes parallel and fixed relative to the plate, front and rear cavities in the bracket corresponding to and receiving the respective front and rear axles, an upper part of each cavity constituting an axle-engaging surface, the front cavity being shaped and dimensioned to enable the bracket to tilt rearwardly about the rear axle by disengagement of the axle-engaging surface thereof from the front axle and the rear cavity being shaped and dimensioned to enable the bracket to tilt forwardly about the front axle by disengagement of the axle-engaging surface thereof from the rear axle, at least one front spring interposed between the plate and the web portion of the bracket forwardly of the rear axle for yieldably restraining the bracket from tilting rearwardly relative to the plate, at least one rear spring interposed between the plate and the web portion of the bracket rearwardly of the front axle for yieldably restraining the bracket from tilting forwardly relative to the mounting plate, and stop means for limiting the extents of forward and backward tilting of the bracket relative to the plate.

28. A seat mount according to claim 27, wherein the stop means is constituted by parts of the axles and parts of the cavities which engage at the limits of tilting of the bracket.

29. A seat mount according to claim 27, wherein the cavities are located in a pair of fittings extending up from the web portion of the bracket, one such fitting being located adjacent each side of the mounting plate and wherein the front and rear axles are composed of segments extending laterally outwardly from each side of the mounting plate.

30. A seat mount according to claim 27, wherein the springs are elastomer cylinders received in downwardly opening cup-like flanges of the mounting plate.

31. A seat mount according to claim 27, and further comprising a front and a rear spring interposed between the mounting plate and the web portion of the bracket, one end of each such spring being engaged by an adjustable abutment for adjustment of the restraining force of the spring.

32. A seat mount according to claim 27, and further comprising means for selectively preventing rearward tilting of the bracket relative to the mounting plate.

33. A seat mount according to claim 32, wherein the means for preventing rearward tilting includes a pin movably supported by the bracket for selective movement into and out of a socket in the mounting plate.

34. A seat mount according to claim 33, wherein the socket is located in an end of the front axle.

* * * * *